US012509984B1

(12) United States Patent
Haldar et al.

(10) Patent No.: US 12,509,984 B1
(45) Date of Patent: Dec. 30, 2025

(54) DUMMY WELL SET-UP FOR TESTING LOGGING TOOLS

(71) Applicant: Saudi Arabian Oil Company, Dhahran (SA)

(72) Inventors: Surajit Haldar, Udhailiyah (SA); Ramiro Andres Cedeño, Udhailiyah (SA); Mauricio Sanchez Bernal, Udhailiyah (SA); Muhammad Syafruddin, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/760,958

(22) Filed: Jul. 1, 2024

(51) Int. Cl.
*E21B 47/00* (2012.01)
*E21B 47/117* (2012.01)
*E21B 49/00* (2006.01)

(52) U.S. Cl.
CPC ..... *E21B 47/006* (2020.05); *E21B 47/117* (2020.05); *E21B 49/008* (2013.01); *E21B 2200/20* (2020.05)

(58) Field of Classification Search
CPC .... E21B 47/006; E21B 47/117; E21B 49/008; E21B 2200/20
See application file for complete search history.

(56) References Cited

U.S. PATENT DOCUMENTS 10,095,819 B2 * 10/2018 Li ..... E21B 7/00
10,767,428 B2 * 9/2020 Yang ..... E21B 21/08
10,876,397 B2 * 12/2020 Yang ..... E21B 21/08
11,111,773 B1 * 9/2021 Zeghlache ..... E21B 47/095
11,150,232 B2 * 10/2021 Li ..... G01N 3/12

FOREIGN PATENT DOCUMENTS

CN 116084912 A * 5/2023 ..... E21B 41/00

* cited by examiner

*Primary Examiner* — Matthew R Buck
(74) *Attorney, Agent, or Firm* — Fish & Richardson P.C.

(57) ABSTRACT

A dummy well set up for testing down-hole tools includes a plurality of concentric tubulars, which can include man-made defects at known locations. Testing the down-hole tool using the dummy well set up can include running a down-hole logging tool into a dummy well, the dummy well comprising a tubular; determining production conditions to simulate a well, the production conditions including a content, pressure, and temperature of a production fluid simulant; pumping the production fluid simulant into the dummy well through a flow-in tube; measuring at least one production characteristic using the downhole logging tool; and evaluating the downhole logging tool based on the production conditions.

20 Claims, 11 Drawing Sheets

DUMMY WELL SET-UP FOR TESTING LOGGING TOOLS

TECHNICAL FIELD

This disclosure pertains to a dummy well set-up and method of testing production and well integrity logging tools using a dummy well set-up.

BACKGROUND

Wellbore tubular and cement condition impacts well integrity, and therefore can impact health, safety, and the environment (HSE) as well as the efficiency of oil and gas production. Downhole logging tools, such as production logging tool (PLT), corrosion logging tool (CLT) and leak detection tool (LDL), are run into a well to detect potential defects in one or more well tubulars positioned in a wellbore and downhole production performance of the well. Downhole logging tools employs various sensors for collar locating, telemetry, gamma ray, pressure, temperature, fluid density, fluid capacitance, fluid flow rate, corrosion identification, and leak detection.

SUMMARY

The present disclosure describes techniques that can be used for testing and calibrating production logging tools, corrosion logging tool, and leak detection tool using a dummy well-set up.

In some implementations, a computer-implemented method includes the following.

Aspects of the embodiments are directed to a method comprising running a downhole logging tool into a dummy well, the dummy well comprising a tubular; determining production conditions to simulate a well, the production conditions including a content, pressure, and temperature of a production fluid simulant; pumping the production fluid simulant into the dummy well through a flow-in tube; measuring at least one production characteristic using the downhole logging tool; and evaluating the downhole logging tool based on the production conditions.

Aspects of the embodiments are directed to a system comprising a dummy well comprising a plurality of concentric tubulars; a landing base to support the plurality of concentric tubulars; a flow-in tube comprising an inlet to receive production fluid simulant and a plurality of perforations to output production fluid simulant downhole of the dummy well; and a flow regulating device to control production conditions of production fluid simulant downhole of the dummy well.

In some implementations, the production conditions comprise a flow-rate for the production fluid simulant to flow through the well.

In some implementations, the content of the production fluid simulant comprises one or a combination of water, oil, steam, and nitrogen.

In some implementations, the production conditions comprise a downhole temperature in a range from 200 to 250 Fahrenheit.

In some implementations, the production conditions comprise a downhole pressure in a range from 2000 to 2500 pounds per square inch.

In some implementations, evaluating the downhole logging tool comprises comparing measured production values against predicted production values.

In some implementations, the tubular comprises a man-made defect.

In some implementations, the downhole tool comprises a corrosion detection tool, the method including determining, using the corrosion detection tool, one or more of a location, type, or severity of the man-made defect; and determining the accuracy of the corrosion tool by comparing the determined location, type or severity of the man-made defect against known information.

Some implementations include measuring pressure at a landing base and determining the affect of the man-made defect on production based on the measured pressure.

In some implementations, the flow regulating device is configured to control a pressure and temperature of the production fluid simulant downhole.

Some implementations include a downhole logging tool configured to measure one or more downhole conditions.

In some implementations, at least one of the concentric tubulars comprises a man-made defect of a known type at a known location and with a known severity.

Some implementations include a corrosion detection tool configured to determine a location, type, and severity of the man-made defect.

Some implementations include a leak detection tool to determine a leak caused by the man-made defect.

In some implementations, the landing base comprises a man-made defect.

Some implementations include a pressure sensor to determine an affect of the man-made defect at the landing base.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method/the instructions stored on the non-transitory, computer-readable medium.

The subject matter described in this specification can be implemented in particular implementations, so as to realize one or more of the following advantages. For example, production and well integrity logging tools can be tested in dummy well set-ups that simulate real-world oil and gas field environments. The testing and calibration of production and well integrity logging tools in such environments increases their reliability when use in real-world oil and gas wells. Highly reliable production and well integrity logging tools mitigate risks associated with compromised wellbores and leaks resulting therefrom.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

Figure 5A:
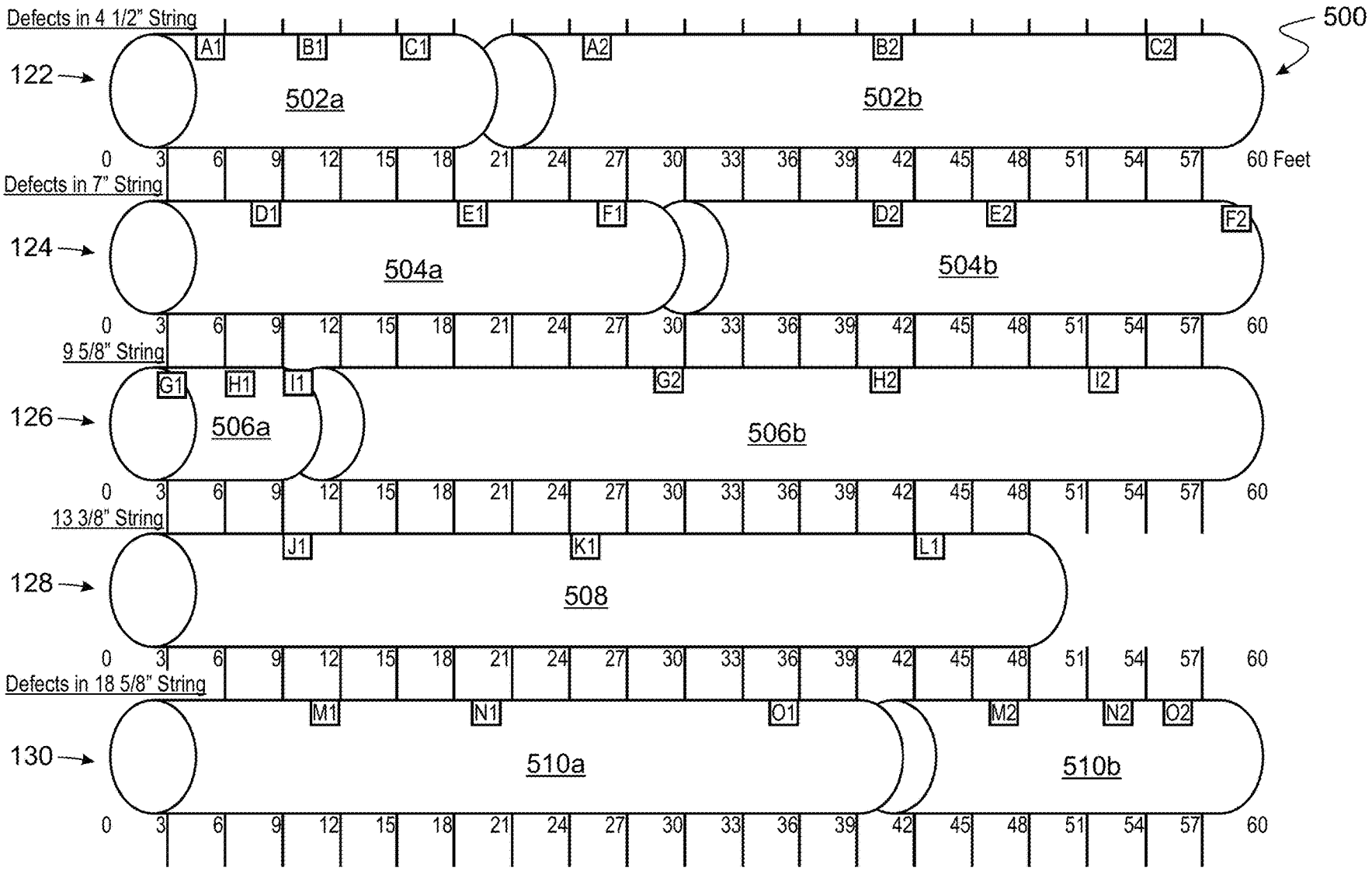
FIG. 5 is a schematic diagram illustrating example defect locations on different tubulars and casings for the dummy well set-up of FIGS. 1A-C in accordance with some implementations of the present disclosure.
Figure 5B:
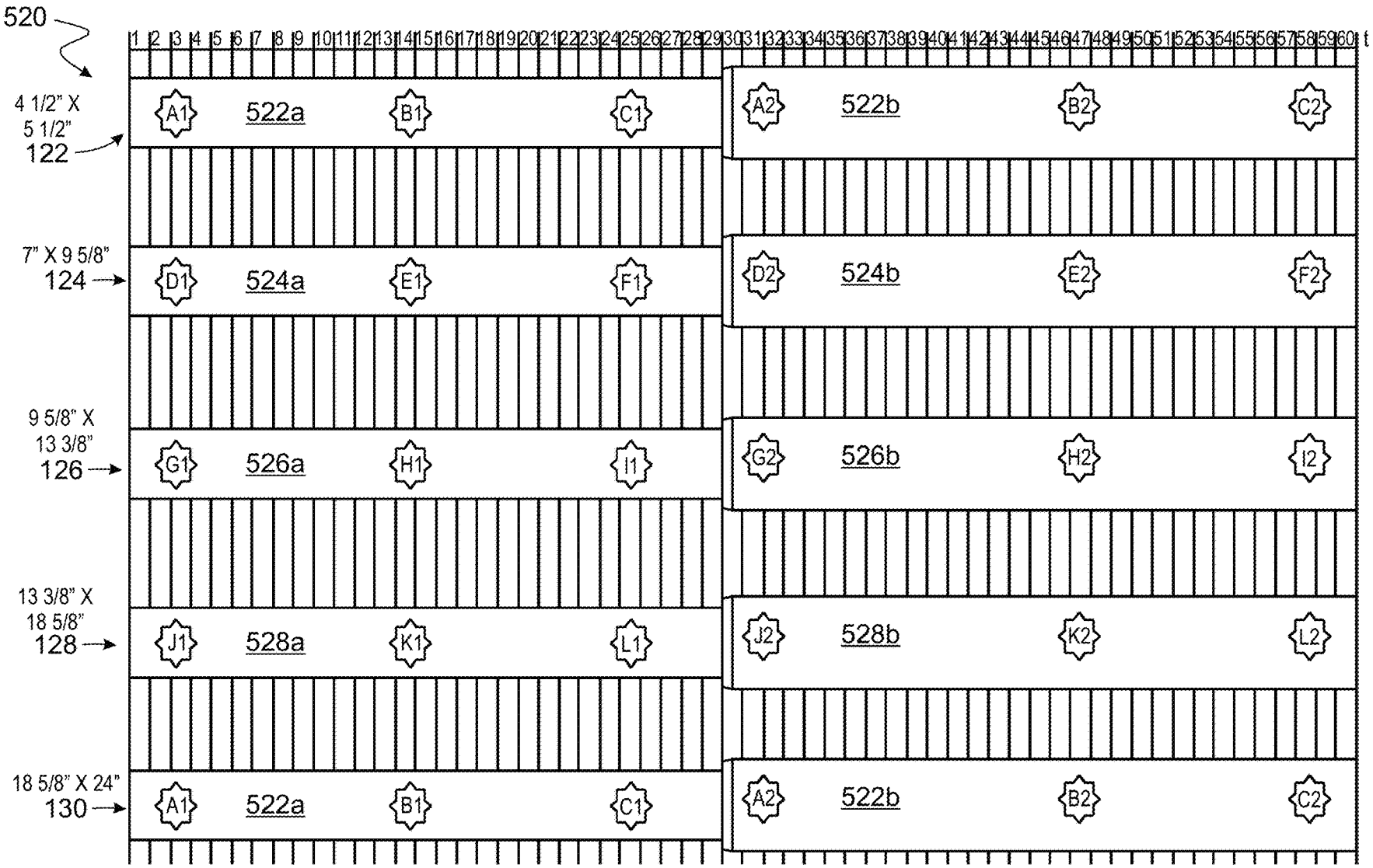

It is not included the description for FIGS. 5A and 5B.

Figure 1A:
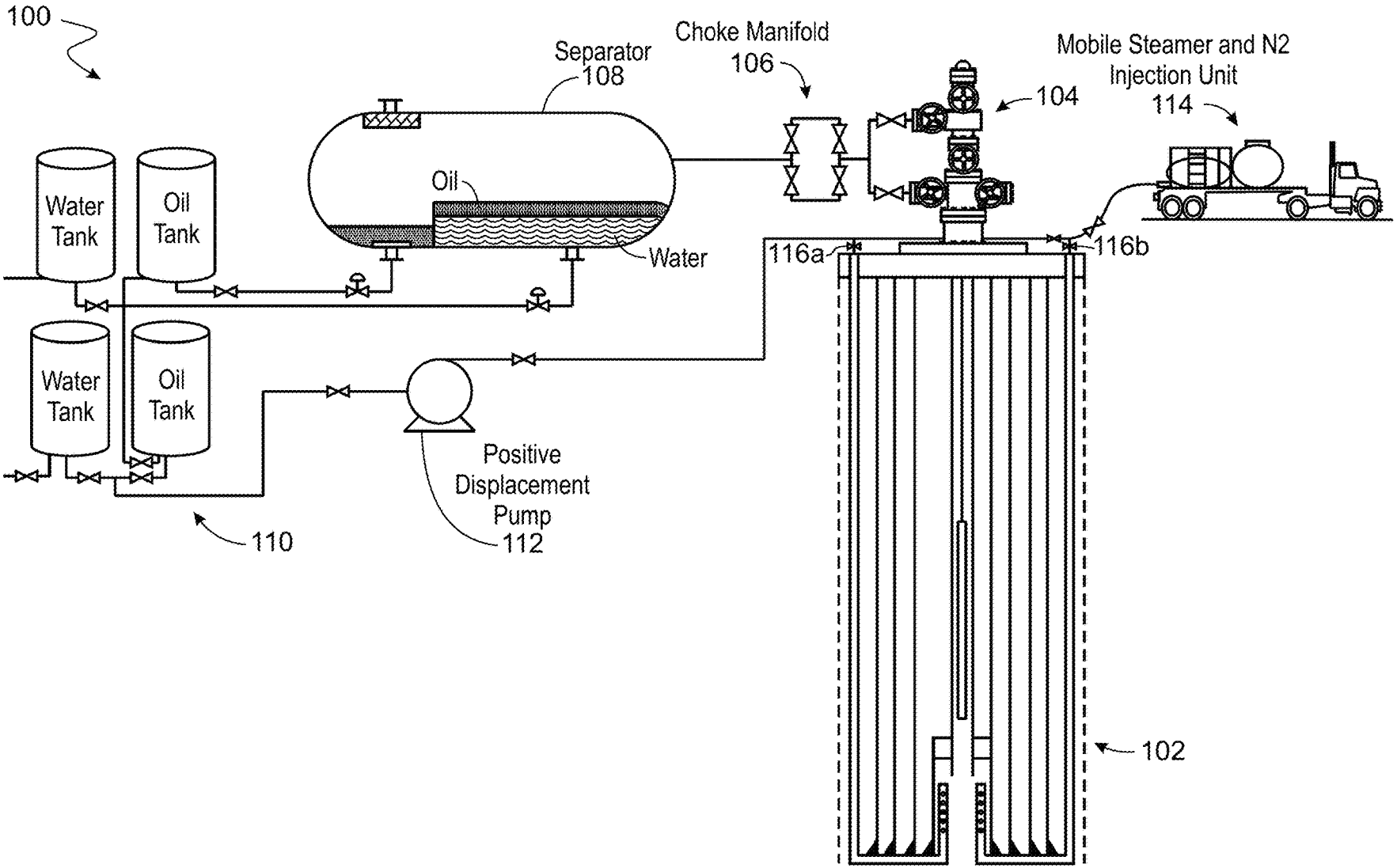
FIG. 1A is a schematic diagram of a dummy well set-up according to some implementations of the present disclosure.
Figure 1B:
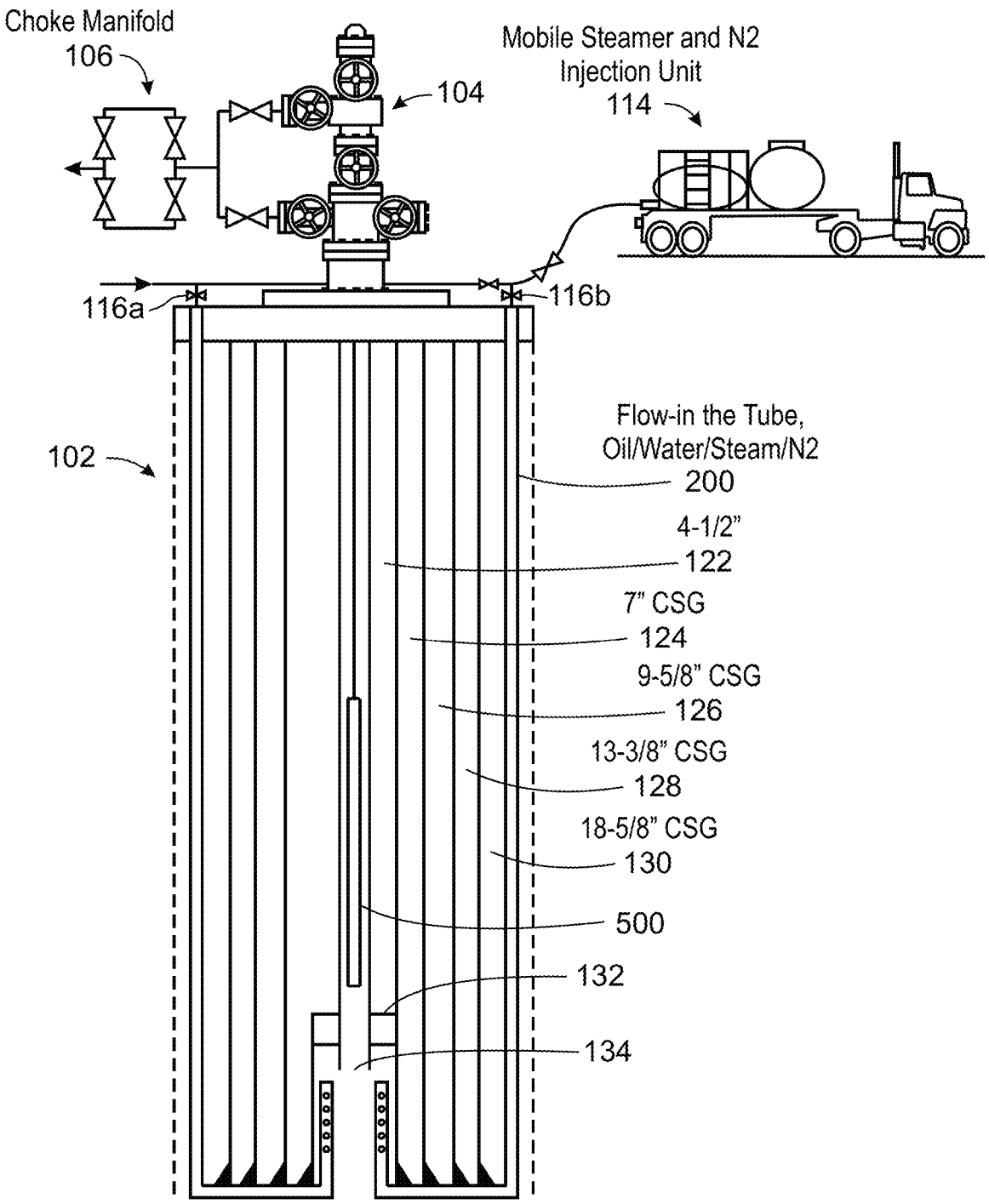
FIG. 1B is a schematic diagram of a close-up view of example tubulars and a flow-in tube for the dummy well set-up of FIG. 1A in accordance with some implementations of the present disclosure.
Figure 1C:
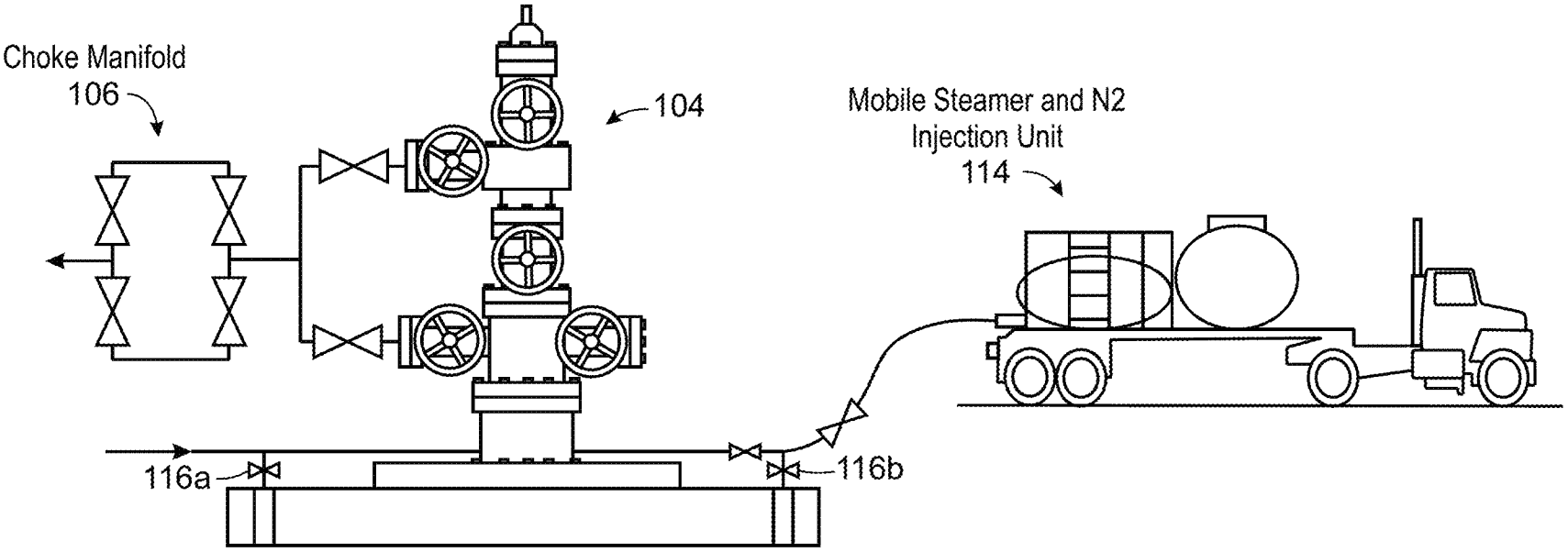
FIG. 1C is a schematic diagram of a close-up view of an example landing base for the dummy well set-up of FIG. 1A in accordance with some implementations of the present disclosure.
Figure 6:
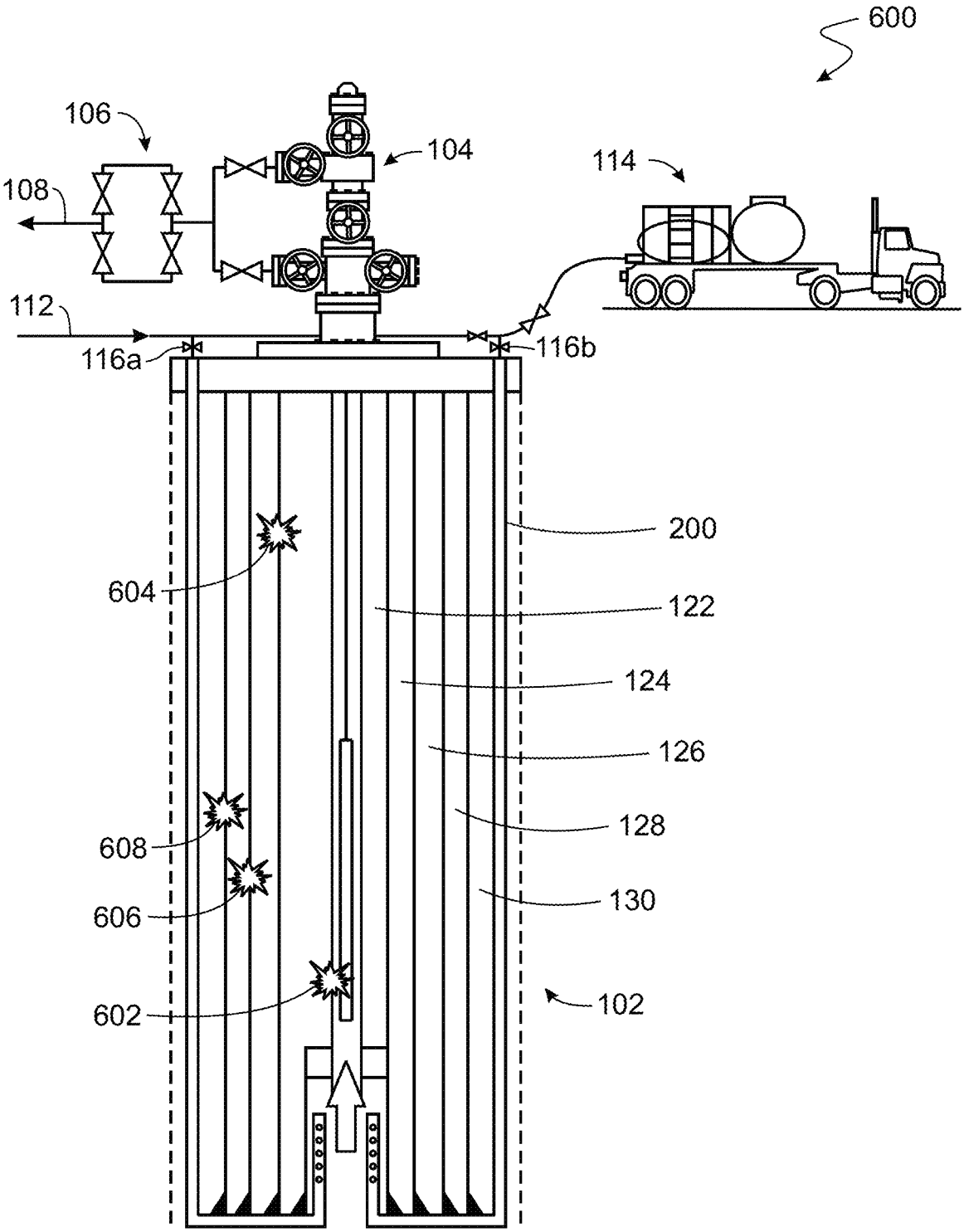

FIG. 6 is a schematic diagram illustrating operation of the dummy well set-up of FIGS. 1A-C to perform leak detection testing in accordance with some implementations of the present disclosure.

Figure 7:
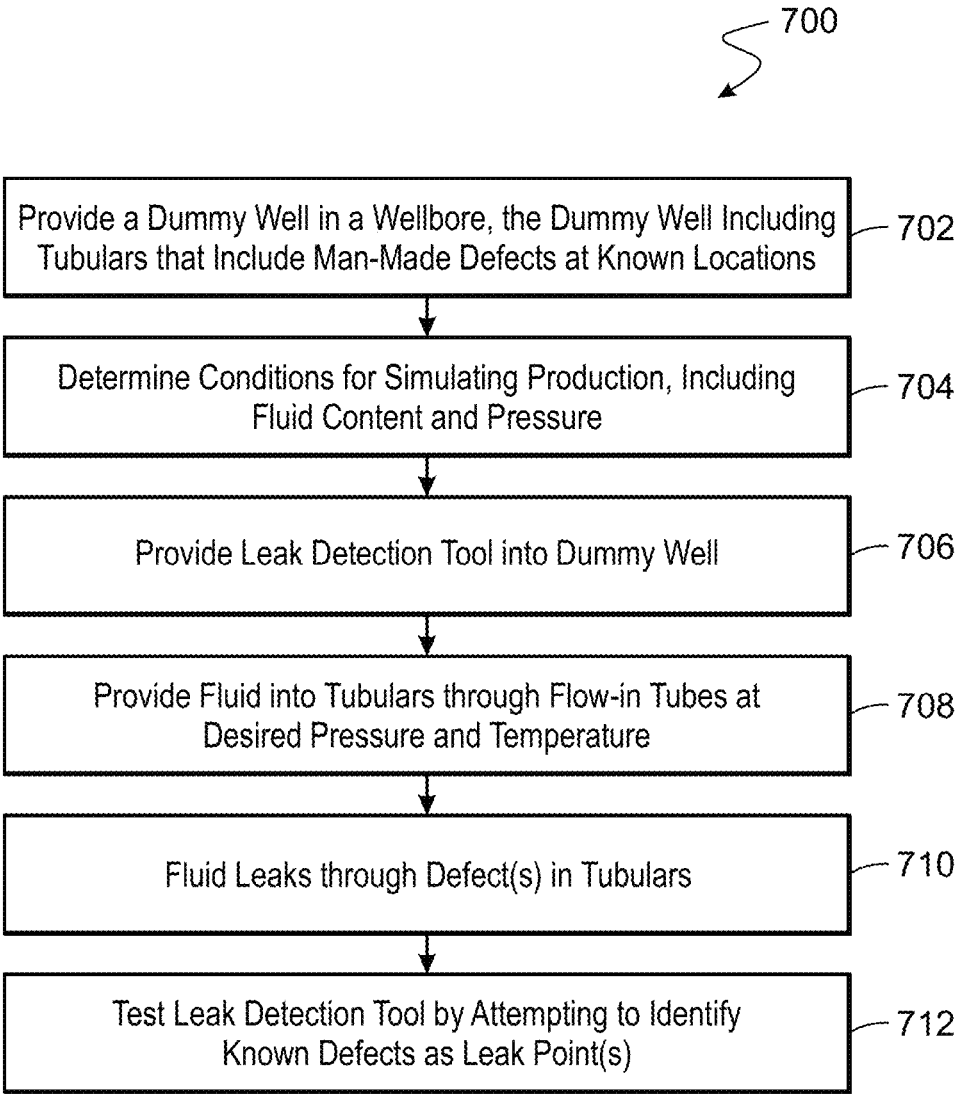

FIG. 7 is a process flow diagram for performing leak detection testing using the dummy well set-up of FIGS. 1A-C in accordance with some implementations of the present disclosure.

Figure 8:
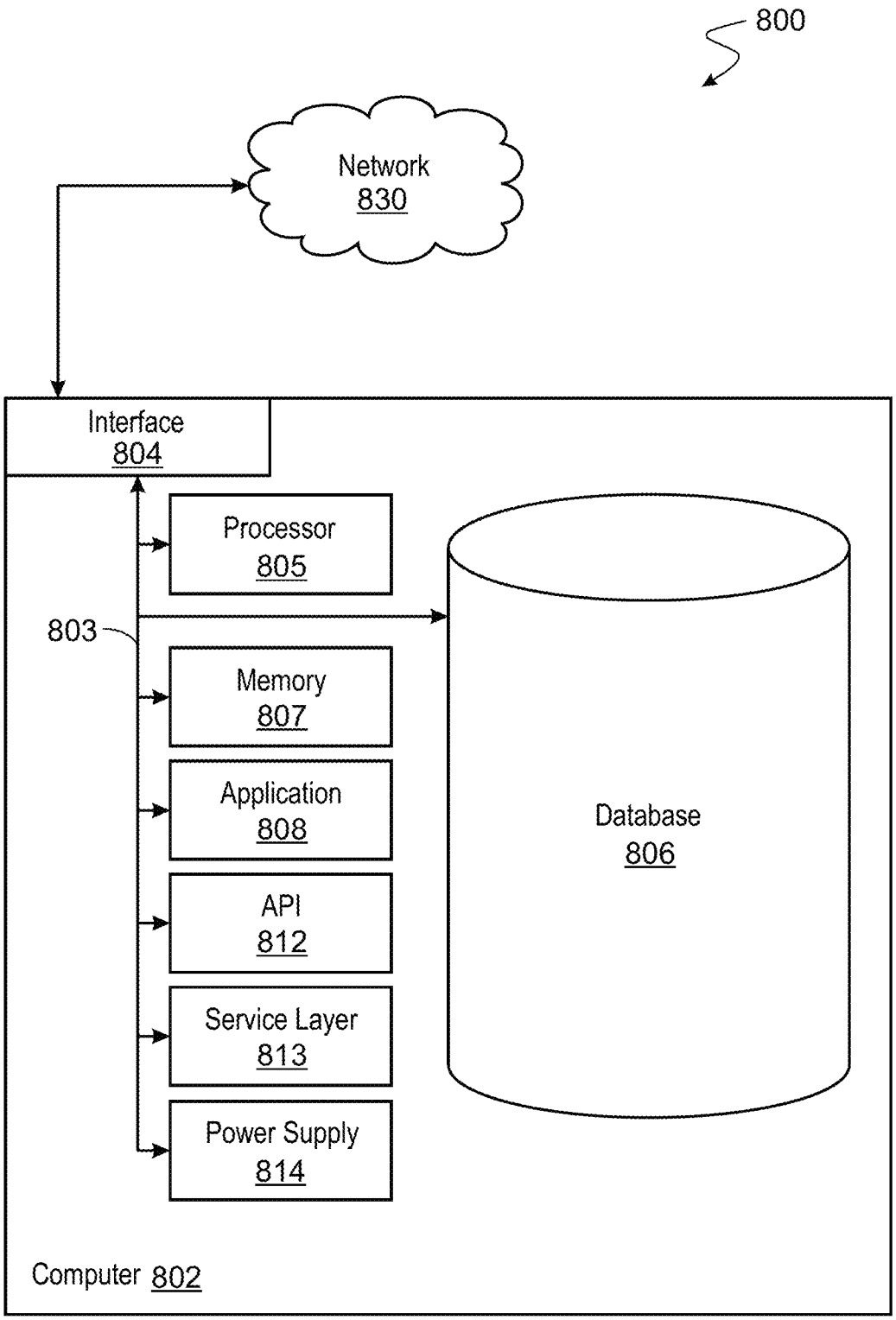

FIG. 8 is a block diagram illustrating an example computer system used to provide computational functionalities associated with described algorithms, methods, functions, processes, flows, and procedures as described in the present disclosure, according to some implementations of the present disclosure.

Like reference numbers and designations in the various drawings indicate like elements.

DETAILED DESCRIPTION

The following detailed description describes techniques for testing production logging tools and/or leak detection tools by simulating oil and gas production environments using a dummy well set-up. Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

This disclosure describes a dummy well set-up and testing method to assess the accuracy, reliability, capabilities, advantages and limitations of production logging tools (PLT), and well integrity logging tools like leak detection tools (LDT), and corrosion logging tools (CLT). The testing methods described herein provide an accessible lab characterization of any existing or new down-well tools available with respect to different specifications of wells as well as with a wide range of different oil and gas field conditions. The dummy well set-up includes concentric tubulars (such as carbon steel tubulars) with known metal losses (also referred to as man-made defects) at different positions and configurations, replicating the most common well completion scenarios and corrosion related metal loss scenarios existing in oil and gas wells.

This disclosure describes creating a well set-up for testing and verification of three logging tools: Corrosion Logging Tool (CLT); Production Logging Tool (PLT); and Leak Detection Logging Tool (LDL).

This disclosure describes a dummy well set-up for testing production logging tool (PLT). This set-up does not require defective tubings, but still makes use of the surface and subterranean dummy configurations. Here, a defective concentric tubing is not essential. Yet, the set up with defective tubing representing an old well can be used as a valuable addition. In addition, a dynamic flow condition is required which is provided by the surface facilities.

Second, this disclosure describe a dummy well set-up for testing Corrosion Logging Tool (CLT) and Leak Detection Logging Tool (LDL)—both tools require the set-up of defected tubulars.

Third, this disclosure describes a dummy well set up for testing Leak Detection Logging Tool (LDL), which uses the described set-up of pre-defected concentric tubulars.

Corrosion logging tool is performed under static condition, no fluid inflow or outflow of the dummy well is necessary. The CLT can be used for the detection of metal loss in terms of percentage of loss in the metal thickness. In addition, the CLT can be used for the detection of metal gain in terms of percentage of gain in metal thickness Corrosion logging tool that can be deployed for testing are:

1) Multi finger caliper (MFC), consist of an array of hard-surfaced fingers which monitor the inner pipe wall only. Each of the sensors generates an independent signal recorded versus depth. MFC can detect wear & deformation, bending, scale deposition, paraffin build-up, location of hole, cracks, or split on the internal surface of the production tubing. In the dummy well set-up, MFC will only be used to examine the internal diameter of the first tubular (4½" tubing).
2) Electromagnetic corrosion tool: it uses various electromagnetic arrangement that respond to changes of metal thickness inside or outside of the tubulars. Unlike MFC, electromagnetic based corrosion tools are able to detect metal defect across the multiple barriers of tubing and casings. In the dummy well set-up up to four defective barriers (4½" tubing, 7" casing, 9⅝" casing, and 13⅜" casing) can be detected by the corrosion logging tools using similar principles of physics.

Leak Detection Logging (LDL) has to be performed under dynamic condition, either by injecting the fluid into the dummy well or by bleeding off the trap pressure in the well annuli (space between each tubular i.e. tubing casing annuli between the 4½" tubing and 7" casing). LDL is based on high precision noise and temperature measurement. Fluid that flows through the leak path creates an acoustical noise and/or changes in the temperature profile that will be detected by the sensors of LDL tool. The LDL can be used for the determination of the location or depth of the leak point in the well (feet). In addition, the LDL can be used for the quantification of the leak rate (gallons/minute).

The testing set-up and testing methods are described in this disclosure as follows:

A) Testing production logging tools using a dummy well set-up and fluids that simulate production fluids. These fluid simulants are introduced into the dummy well tubulars by a flow-in tube at a desired downhole temperature and pressure. A PLT is run into the well. While the fluid simulants are being pumped into the dummy well tubulars, the PLT can record production data. These data can be later analyzed to determine the reliability and accuracy of the PLT.

B) Testing leak or corrosion detection tools using dummy well set-ups that include tubulars with man-made defects at known locations. The dummy wells can be configured for oil wells or gas wells. Leak or corrosion logging works based on the evaluation of metal deterioration in tubing/casing in form of thickness loss, holes, crack, dotted lines, or deformities. This dummy well set-up is designed to facilitate evaluation of various corrosion logging tools that may employs one of the three devices: mechanical, electromagnetic, or ultrasonic (acoustic) measurement. The testing of corrosion or leak detection tools using dummy wells that include man-made defects, and doing so under production conditions, can provide real-world test results for verifying accuracy and reliability of the downhole tools.

Testing of the production logging tool (PLT) includes testing the functionalities and accuracy of arrays of sensors in a PLT that is run into the dummy well. The array of sensors that will be tested as part of the PLT tool include:

a. Fluid properties identification (either by density, capacitance, electrical or optical probe)—a variety of fluid will be injected into the dummy well (water/gas/oil samples of different specific gravity).
b. Fluid velocity by spinner flowmeter or water flow log sensors—injection of fluid with variable rates will be supplied/pumped from the surface which in turn will be produced through the tubing in order to simulate a production well.
c. Tubing internal diameter (ID) measurement by caliper sensor—to be matched with the internal diameter of tubing in the dummy well.
d. Pressure sensor—to be measured against fluid pressure into the well.
e. Temperature sensor—to be measured against supplied heat into the well.
f. CCL (casing collar locator) correlation—to be matched with the joints profile of the production tubing.

PLT can be used to detect downhole fluid properties (density/capacitance), flow velocity and hold-up, pressure, temperature at correlated depth using GR (gamma ray) and CCL (casing collar locator). The final product of PLT measurement is volumetric rate of oil, water, and/or gas at the downhole condition (at an elevated pressure and temperature conditions). PLT are also used to measure production profile changes, fluid type changes (water or gas breakthrough), source of high GOR or water cut, and crossflow between formation.

The accuracy and reliability of the tested PLT tool can be compared with the surface measurement of injected liquid (oil & water) and gas rate into the dummy well. In addition, recorded downhole pressure and temperature by PLT will be verified with surface pressure and temperature injection data.

In an actual well conditions, the accuracy of the result depends on the interpretation of the service/tool providers. This is the reason that the testing set up in a dummy well would verify the functionality and accuracy of the PLT tool where the outcome parameters are known. The following are the comparisons tools:

Downhole flow rate (liquid and gas) is compared with the injection rate supplied to the dummy well.

Pressure and temperature are compared with surface fluid injection pressure/temperature.

CCL is compared with the metallic profile and joints of the production tubing in the dummy well.

X-Y caliper (to measure the ID of the tubular) is compared with the internal diameter of the installed tubing in the dummy well.

GR is the only sensor that cannot be verified in the dummy well configuration.

Moreover, this disclosure will describe the following aspects:

Making of "man-made" defects in tubulars as per matrix specifications. The set-up consist of five concentric tubulars with internal & external type of defects tailored for common set-up of oil and gas well.

Assembly of two sets of concentric tubulars, one for oil wells set-up and second one for gas well set-up, including a dummy landing base for each of them.

Construction of a shallow well for creating custom-made well set-ups.

Reliable testing set-up, resembling oil and gas well tubular configuration, with concentric tubular arrangement can be placed vertically in the dummy well as shown in FIG. 1A. The dummy well 102 must have the ability to mimic the range of wellbore features and conditions such as eccentricity, ovality, different metal corrosion morphologies: intergranular, galvanic, cavitation, erosion, pitting, crevice, metal dissolution, stress-cracking, sulphide stress cracking, fatigue, leaching among others. Annulus spaces could be filled with different materials regularly used in well completions like cement, foam cement, brines, etc.

The preferred location to place and operate the shallow dummy well set-ups must have the following specifications:

Safe, clean, clear and radio-silent;
Fenced and secured facility with controlled access;
Sufficient area to place the set-ups and corrosion logging unit truck;
Rig up the tool on the specific well head;
Run the tool at a slow speed;
Stop against each defective point;
Measure the corrosion/eddy-current as per the logging tool's physics;
Perform the logging from the top to the bottom of the simulated well;
Compare the log with the actual wall thickness of each pipe; and
Assess the accuracy, reliability, capabilities, advantages and limitations of the corrosion logging tool on test.

FIG. 1A is a schematic diagram of a dummy well set-up 100 according to some implementations of the present disclosure. The dummy well set-up 100 includes a dummy well 102. The dummy well 102 can include a plurality of concentric tubulars (shown in more detail in FIGS. 1B, 5A, and 5B. The tubulars are positioned, concentrically, in a relatively shallow wellbore. The wellbore, for example, can be of 80-90 feet deep. The tubulars can be made of carbon steel (CS) (e.g., 13SCr) or from other known materials.

A shallow well of 80' to 90' deep and at least 30" net internal diameter is required to maintain and customize the set-ups. This shallow dummy well is to be constructed anywhere in the oil & gas field or within the office or laboratory compound. Moreover, this dummy well must be guarded with wood or concrete (non-metallic and non-conductive) in order to prevent the hole to collapse as well as to provide an ideal situation wherein different configuration concentric tubulars can be placed to mimic an oil or gas well.

In some implementations, defects can be made on one or more of the tubulars at known locations and of known types and sizes. These defects can be used to test corrosion or leak detection tools during production simulations. Defects include one or more of a hole, a crack (longitudinal and/or radial), dotted line, metal loss, metal gain, and decentralization. Three levels of defect intensity include minor, moderate, and severe, each being defined during implementation. Each defect location can be mapped to a reference point along the tubular using radial and longitudinal references relative to a single reference point. Clock-style locations can also be used. The clock position can be akin to a radial position around the circumference of the tubular. A length position can indicate where along the longitude of the tubular the defect is located. Tubulars and defects are discussed in more detail in FIGS. 5A-5B.

Turning briefly to FIG. 1B, FIG. 1B is a schematic diagram of a close-up view of example tubulars and a flow-in tube for the dummy well set-up of FIG. 1A in accordance with some implementations of the present disclosure. FIG. 1B shows five concentric tubulars of different diameters, and in this case, represent an oil well set-up. The oil well set-up is used as an example, but is not limiting. Gas well set-ups are described later, and can also be used in the FIG. 1A example scenario.

An inner tubular 122 is a 4½" diameters tubular. The second tubular 124 is a 7" diameter tubular. The third tubular 126 is a 9⅝" diameter tubular. The fourth tubular 128 is a 13⅜" diameter tubular. The fifth tubular 130 is a 18⅝" diameter tubular. A packer 132 can also be added to the inner tubular 122 to ensure production fluid simulant is directed into the well.

The dummy well 102 also includes a flow-in tube 200. Flow-in tube 200 can be accessed at the surface by in-flow pipes 116*a* and 116*b*. The flow-in tube 200 can include perforations for delivering production fluid simulant downhole at a desired temperature and pressure. The flow-in tube is discussed more in FIG. 2. The production fluid simulant can be pumped downhole by a pump 112, which can be a positive displacement pump or other type of pump. The pump 112 can pump one or a combination of fluids from a tank 110 to the in-flow pipes 116*a* and 116*b*. The production fluid simulant can be a combination of fluids, such as water, oil, steam, and nitrogen. Steam and nitrogen (N2) can be delivered by a mobile unit 114 or a stationary unit (not shown).

FIG. 1B illustrates a downhole logging tool 500 that is run downhole. The downhole logging tool can be a production logging tool that is used to evaluate fluid movement in and out of the wellbores. The data collected by PLT 500 during production simulation can be used to quantify flow rates and to identify fluid properties at downhole conditions. PLT 500 consist of spinner flowmeter to quantify fluid velocity, density/electrical/optical probe to indetify fluid hold-up, and auxiliary devices i.e. CCL, GR, thermometer, caliper, and pressure. The dummy well 102 facilitates evaluation of any type PLT 500 by facilitating dynamic well flow into and out of the dummy well 102, imitating the common downhole conditions at a desired, elevated pressure and temperature.

The dummy well 102 is supported at the surface by a landing base 104. FIG. 1C is a schematic diagram of a close-up view of an example landing base 104 for the dummy well set-up 100 of FIG. 1A in accordance with some implementations of the present disclosure. Landing base 104 provides structural support for the casing string, the well head and tree during producing operations. A dummy landing base with man-made defects is to be connected to one of the sides of each set-up (oil and gas). The landing base 104 can include a tree type of valve system for directing fluid simulants from the well to other surface locations, such as the separator 108. The landing base 104 can include a conductor embedded in a cement cap. The landing base 104 can also include a surface casing separated from the Christmas tree by a donut plate. In some implementations, man-made defect can be added to the landing base at one or more places to simulate a defect.

The landing base 104 can be connected to a choke manifold 106 that can be used to control pressure of production fluid simulant output from the well during production and leak detection simulation. The choke manifold 106 can be made of a plurality of valves for controlling output pressure of the production fluid simulant. The choke manifold 106 can output production fluid simulant to a separator 108. Separator 108 can separate oil from water, and output oil and water into tanks 110 for later use. The choke manifold is arrangement where the choke size can be adjusted based on required rate or pressure. A pressure gauge/sensor will be mounted in the upstream and downstream of the choke manifold to regulate the fluid rate by adjusting the size of the choke opening.

Figure 2:
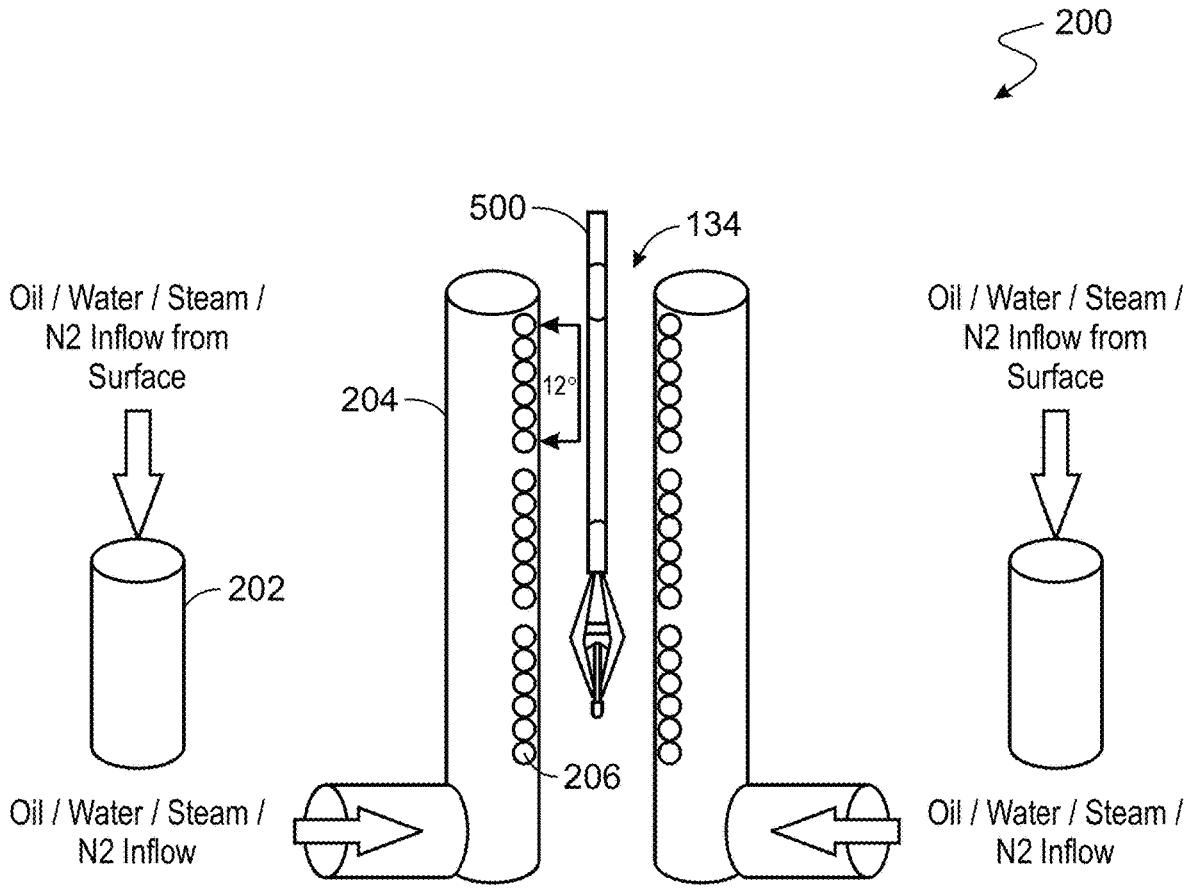
FIG. 2 is a schematic diagram of close-up view of the example flow-in tube for the dummy well set-up of FIGS. 1A-C in accordance with some implementations of the present disclosure.

FIG. 2 is a schematic diagram of close-up view of the example flow-in tube 200 for the dummy well set-up of FIGS. 1A-C in accordance with some implementations of the present disclosure. The flow-in tube 200 includes an in-flow tube section 202 that is connected to the in-flow pipes 116*a* and 116*b*. The in-flow tube section 202 directs the production fluid simulant downhole. The flow-in tube 200 includes an out-flow section 204 that includes a plurality of perforations 206. The perforations 206 allow the production fluid simulant into the annulus 134 of the inner tubular 122 of the dummy well 102.

Figure 3:
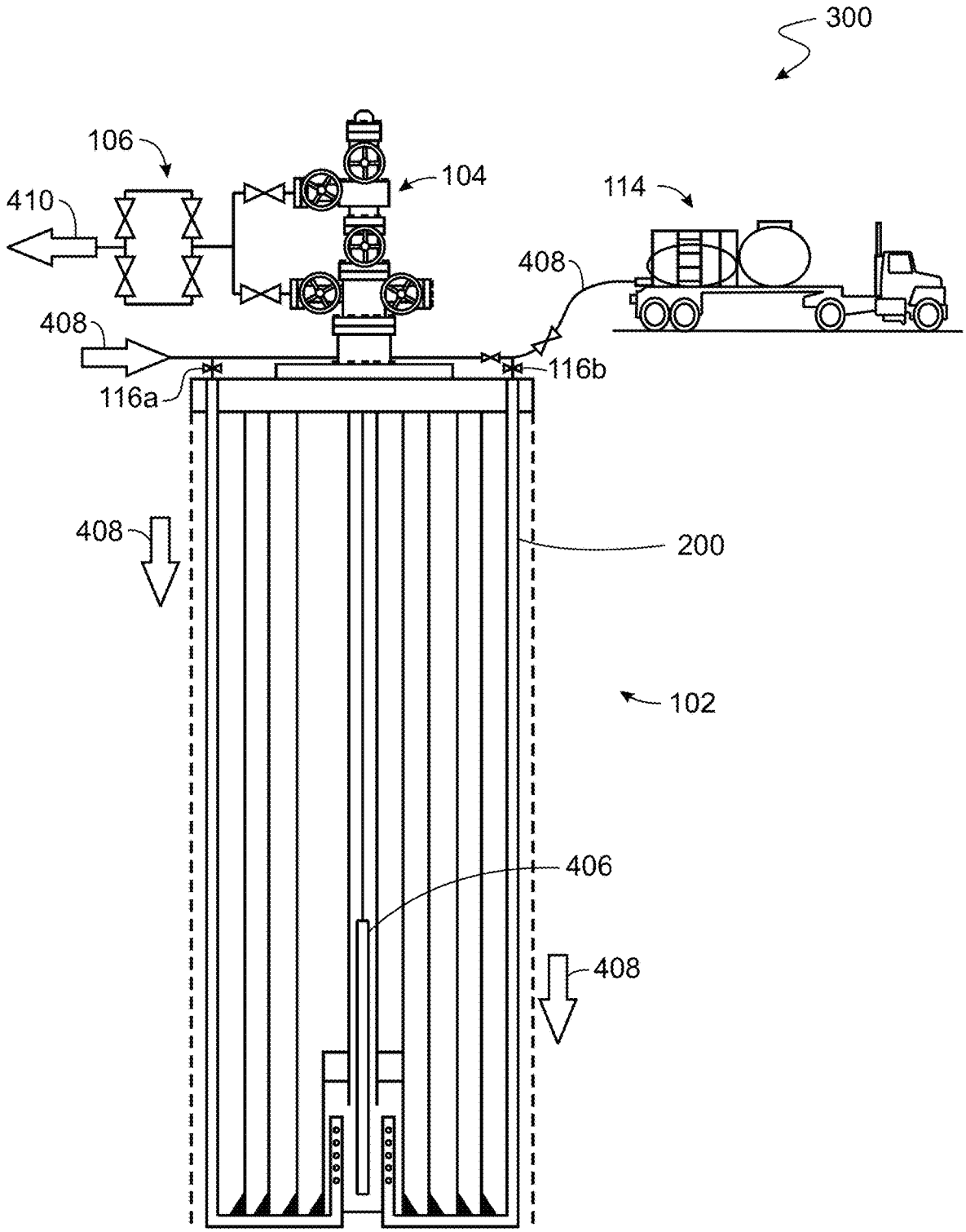
FIG. 3 is a schematic diagram illustrating operation of the dummy well set-up of FIGS. 1A-C to test a production logging tool under production conditions in accordance with some implementations of the present disclosure.
Figure 4:
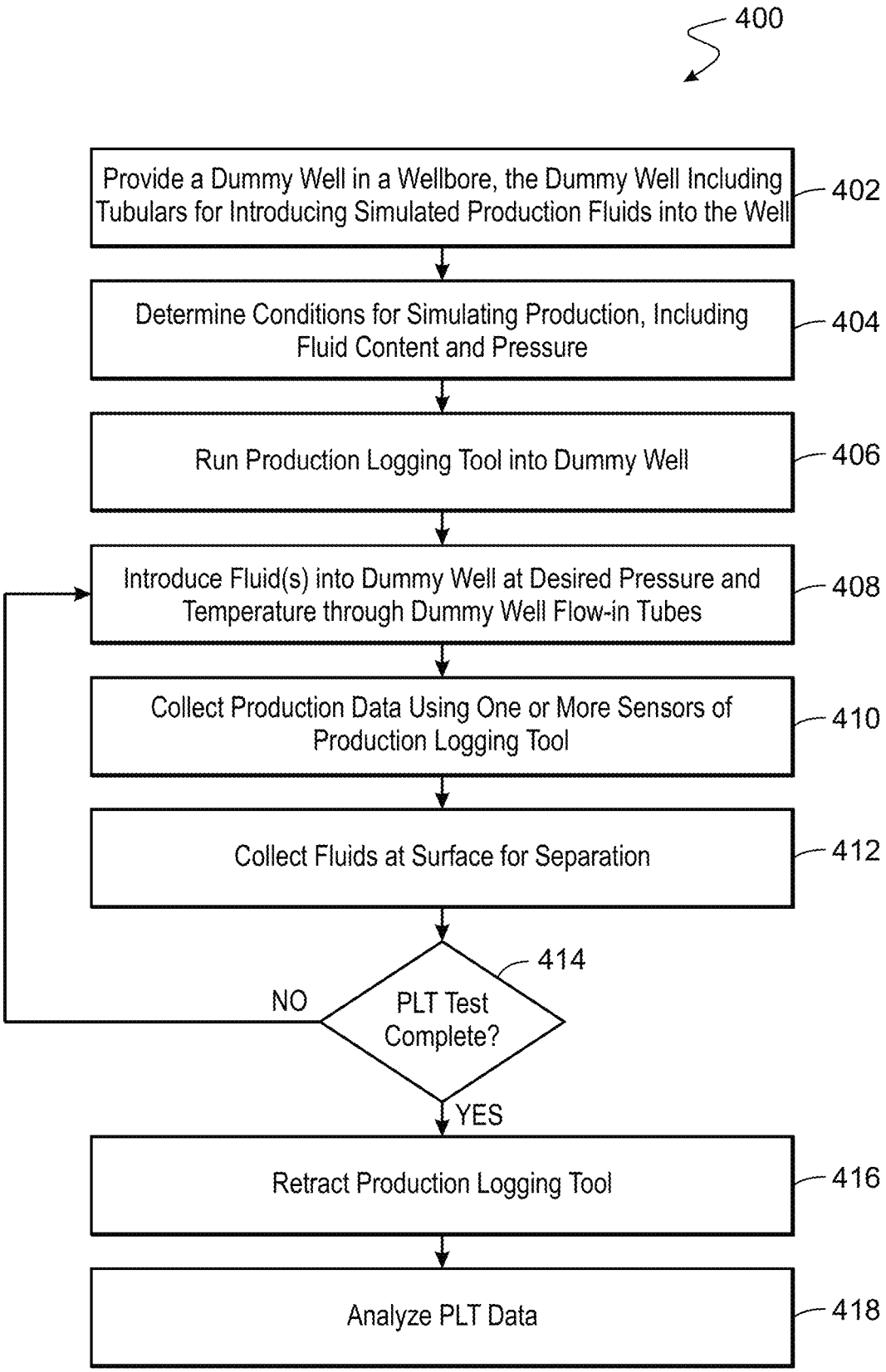
FIG. 4 is a process flow diagram for testing a production logging tool using the dummy well set-up of FIGS. 1A-C under production conditions in accordance with some implementations of the present disclosure.

FIG. 3 is a schematic diagram illustrating operation of the dummy well set-up of FIGS. 1A-C to test a production logging tool under production conditions in accordance with some implementations of the present disclosure. FIG. 4 is a process flow diagram for testing a production logging tool using the dummy well set-up of FIGS. 1A-C under production conditions in accordance with some implementations of the present disclosure. FIGS. 3 and 4 can be taken together.

As a preliminary matter, a dummy well 102 is provided into a shallow well. (402) The dummy well 102 can include a plurality of concentric tubulars, as shown in FIG. 1A-B. The testing parameters can be determined. (404) For example, the production fluid simulant can be formulated for the test, which can include water, oil, steam, nitrogen, or other materials. The production fluid stimulant downhole pressure and temperature can also be determined. Other production conditions can also be determined and simulated.

At 406, the PLT 500 can be run inside the dummy well to log the dummy well. The dummy well 102 facilitates evaluation of any type PLT 500 by enabling dynamic well flow into and out of the well imitating the common downhole condition at elevated pressure and temperature. PLT 500 can collect fluid volumetric rate, fluid properties identification, pressure, temperature, and/or casing collar locator (CCL) profile.

At 408, the production fluid simulant is introduced into the dummy well. As an example, the production fluid simulant can include Oil, Water, N2 gas, and/or steam. The steam is injected to reach the desired downhole temp of 200-250 deg F. N2 gas similarly is injected to reach the desired downhole pressure of 2000-2500 psi. Note that pressure and temperature are the main parameters simulated in the dummy well to resemble the typical downhole condition of an oil or gas well. A preheater at surface will be used to achieve the simulated temperature. Similarly, surface pumps will be used to maintain the required pressure. 100-200° F. temperature or 1000-2000 psi pressure ranges are easily achievable from surface facilities. In addition, the pre-perforated tubing at the bottom of the dummy well simulates the cased hole perforated lower completion of a common oil or gas well. The pre-perforated design comprises of 3 ft length with a standard perforating density of 6 shot per foot and zero-degree phasing.

At step 410, the PLT 500 can collect data during the production simulation.

At step 412, at the surface, the fluid outflow separated and pressurized for continuous injection into the well.

At step 414, if the testing is complete, then the PLT 500 can be retracted. (416)

At step 418, the PLT data can be evaluated and compared against known conditions to determine the accuracy and reliability of the PLT 500.

If testing is not complete, the production fluid simulant can be continually introduced into the dummy well 102 until the testing is over.

In some implementations, the production logging tool can be tested after the well is shut-in. The well can be shut-in using the tree or other components of the landing base 104. In addition, the fluid inflow is stopped. Then, the production logging tool can be used to measure shut-in conditions.

Leak Detection

The leak detection tool is aimed to locate tubing/casing leak and fluid movement behind pipe. The tool can be based on temperature profiling, noise logging, oxygen activation or spinner. Temperature survey and Noise logging are the most common leak detection tools: Temperature log identify anomalies in the temperature profile with depth compare to the normal geothermal gradient. Noise logging tool captures the acoustic noise that generated by fluid that flows through hole-type defect in tubing or casing.

FIG. 5A is a schematic diagram illustrating example defect locations on different tubulars and casings for the dummy well set-up of FIGS. 1A-C for mimicking an oil well set-up in accordance with some implementations of the present disclosure. The same set-up of the corrosion logging defect pipe is utilized for testing of leak detection logging (LDL). The tubulars include defects, which are the main sources of flow communication from tubing to the surrounded casings.

Set-Up Specifications Mimicking Oil Wells

The Oil set-up consists of five (05) concentric tubulars with the following specifications:

| Pipe Section No. | Diameter (in) | Grade | Weight (lb) | Thickness (in) |
|---|---|---|---|---|
| 1 | 4½" | J-55 | 11.5 | 0.500 |
| 2 | 7" | J-55 | 23 | 0.634 |
| 3 | 9⅝" | J-55 | 36 | 0.704 |
| 4 | 13⅜" | J-55 | 61 | 0.860 |
| 5 | 18⅝" | K-55 | 87.5 | 0.870 |

Table 1: Specification of oil set-up consists of five concentric tubulars

Each tubular in this example has two joints: each joint being 30 feet in length. The metallurgy for the tubulars are all carbon steel (CS).

For example, tubular 122 includes a first section 502*a* and a second section 502*b*. Tubular 124 includes a first section 504*a* and a second section 504*b*. Tubular 126 includes a first section 506*a* and a second section 506*b*. Tubular 128 includes a first section 508. Tubular 130 includes a first section 510*a* and a second section 51*pb*.

Nominal thickness will be measured physically for more accuracy.

The recommended man-made defects are described in the following table and figure.

Table 2 shows example defects and their respective locations, types, and severities, on the first joints of tubulars shown in FIG. 5A.

| Joint 1 | | | | | | |
|---|---|---|---|---|---|---|
| | | | | | Defect location | |
| Pipe Section | Defect | Length (ft) | Defect type | Defect intensity | Clock Position | Interval |
| 4 ½" | A | 20 | Hole | Significant | 12 | 5-6 |
| 4 ½" | B | 20 | Crack | Intensive | 9 | 10-11 |
| 4 ½" | C | 20 | Metal Loss | Moderate | 3 | 15-16 |
| 7" | D | 30 | Dotted line | Significant | 6 | 8-9 |
| 7" | E | 30 | Metal gain | Moderate | 6 | 18-19 |
| 7" | F | 30 | Crack | Moderate | 3 | 25-26 |
| 9 ⅝" | G | 10 | Metal loss | Moderate | 12 | 2-3 |
| 9 ⅝" | H | 10 | Hole | Significant | 9 | 6-7 |
| 9 ⅝" | I | 10 | Crack | Intensive | 3 | 9-10 |
| 13 ⅜" | J | 50 | Dotted line | Moderate | 6 | 9-10 |
| 13 ⅜" | K | 50 | Hole | Intensive | 9 | 24-25 |
| 13 ⅜" | L | 50 | Hole | Significant | 12 | 42-43 |
| 18 ⅝" | M | 40 | Crack | Significant | 9 | 11-12 |
| 18 ⅝" | N | 40 | Dotted line | Intensive | 3 | 20-21 |
| 18 ⅝" | O | 40 | Metal loss | Moderate | 6 | 35-36 |

Table 2: Description of man-made defects in oil well set-up

Table 3 shows example defects and their respective locations, types, and severities, on the second joints of tubulars shown in FIG. 5A:

| Joint 2 | | | | | | |
|---|---|---|---|---|---|---|
| | | | | | Defect Location | |
| Pipe Section | Defect | Length (ft) | Defect Type | Defect intensity | Clock Position | Interval |
| 4 ½" | A | 40 | Dotted line | Intensive | 6 | 6-7 |
| 4 ½" | B | 40 | Metal gain | Moderate | 3 | 21-22 |
| 4 ½" | C | 40 | Crack | Significant | 12 | 34-35 |
| 7" | D | 30 | Dotted line | Intensive | 9 | 11-12 |
| 7" | E | 30 | Metal gain | Moderate | 3 | 16-17 |
| 7" | F | 30 | Centralization | Significant | 12 | 24-25 |
| 9 ⅝" | G | 50 | Hole | Significant | 6 | 20-21 |
| 9 ⅝" | H | 50 | Hole | Intensive | 3 | 31-32 |
| 9 ⅝" | I | 50 | Crack | Moderate | 9 | 41-42 |
| 13 ⅜" | J | 0 | Metal loss | | | |
| 13 ⅜" | K | 0 | | | | |
| 13 ⅜" | L | 0 | | | | |
| 18 ⅝" | M | 20 | | Moderate | 6 | 6-7 |
| 18 ⅝" | N | 20 | Hole | Intensive | 6 | 12-13 |
| 18 ⅝" | O | 20 | Crack | Significant | 12 | 16-17 |

Table 3: Description of man-made defects in oil well set-up

FIG. 5B is a schematic diagram illustrating example defect locations on different tubulars and casings for the dummy well set-up of FIGS. 1A-C for mimicking a gas well set-up in accordance with some implementations of the present disclosure. For example, tubular 122 includes a first section 522*a* and a second section 522*b*. Tubular 124 includes a first section 524*a* and a second section 524*b*. Tubular 126 includes a first section 506*a* and a second section 526*b*. Tubular 128 includes a first section 528*a* and a second section 528*b*. Tubular 130 includes a first

| Pipe No. | Diameter | Grade | Weight (lb) | Thickness | Connection | Metallurgy |
|---|---|---|---|---|---|---|
| 1 | 4 ½" | 95HCS | 13.5 | 0.290 | Vam Top HC | Carbon Steel |
| 2 | 7" | VMS | 32 | 0.453 | Vam Top HC | Carbon Steel |
| 3 | 9 ⅝" | NK-C95ST | 53.5 | 0.545 | NK3SB | Carbon Steel |
| 4 | 13 ⅜" | VM95HC | 72 | 0.625 | Vam Top HC | Carbon Steel |
| 5 | 18 ⅝" | K-55 | 115 | 0.594 | BTC | Carbon Steel |

Table 4: Section #1 Configuration of the gas tubular.

Table 5 shows example structures for the second sections of the tubulars shown in FIG. 5B.

| Pipe No. | Diameter | Grade | Weight (lb) | Thickness | Connection | Metallurgy |
|---|---|---|---|---|---|---|
| 1 | 5 ½" | NK Cr 13S-95 | 20 | 0.361 | Vam Top HC | S13Cr |
| 2 | 9 ⅝" | NKA-C95ST | 53.5 | 0.545 | NK3SB | Carbon Steel |
| 3 | 13 ⅜" | VM95HC | 72 | 0.625 | Vam Top HC | Carbon Steel |
| 4 | 18 ⅝" | K-55 | 115 | 0.594 | BTC | Carbon Steel |
| 5 | 24" | X-42 | 176 | 0.688 | RL-4S | Carbon Steel |

Table 5: Section #2 Configuration of the gas tubular.

Example man-made defects for the gas tubulars in Section 1 are described in the following Table 6. Both section 1 and section 2 have lengths of 30 feet.

| Section 1 | | | | Defect Location | |
|---|---|---|---|---|---|
| Defect | Casing Size | Defect Type | Defect Intensity | Clock Position | Interval |
| A | 4½" | Surface corroded with a HCl Acid 15% (internal wash out) | Significant | 6 | 2-4 |
| B | 4½" | Internal and External Scattered Holes combined with tube ovalization | Moderate | 9 | 14-16 |
| C | 4½" | Metal loss (different percentages) | Intensive | 7 | 26-29 |
| D | 7" | Internal and External Scattered Holes combined with tube ovalization | Moderate | 8 | 3-7 |
| E | 7" | Metal loss (different percentages) | Intensive | 4 | 11-15 |
| F | 7" | Longitudinal and radial crack | Significant | 6 | 21-22 |
| G | 9⅝" | Metal loss (different percentages) | Moderate | 2 | 6-10 |
| H | 9⅝" | Longitudinal and radial crack | Significant | 9 | 13-18 |
| I | 9⅝" | Internal and External Scattered Holes combined with tube ovalization | Intensive | 3 | 22-26 |
| J | 13⅜" | Longitudinal and radial crack | Intensive | 3 | 8-11 |
| K | 13⅜" | Internal and External Scattered Holes combined with tube ovalization | Moderate | 7 | 17-22 |
| L | 13⅜" | Metal loss (different percentages) | Intensive | 6 | 21-25 |
| M | 18⅝" | Internal and External Scattered Holes combined with tube ovalization | Moderate | 10 | 5-6 |
| N | 18⅝" | Metal loss (different percentages) | Intensive | 4 | 19-23 |
| O | 18⅝" | Longitudinal and radial crack | Significant | 8 | 27-29 |

Table 6. Example defect configuration in Section 1 of FIG. 5B.

TABLE 7

| Section 2 | | | | Defect Location | |
|---|---|---|---|---|---|
| Defect | Casing Size | Defect Type | Defect Intensity | Clock Position | Interval |
| A | 5½" | Surface corroded with a HCI Acid 15% (internal wash out) | Moderate | 7 | 28-30 |
| B | 5½" | Internal and External Scattered Holes combined with tube ovalization | Significant | 2 | 17-21 |
| C | 5½" | Metal loss (different percentages) | Moderate | 9 | 4-7 |
| D | 9⅝" | Internal and External Scattered Holes combined with tube ovalization | Intensive | 5 | 20-24 |
| E | 9⅝" | Metal loss (different percentages) | Moderate | 11 | 15-20 |
| F | 9⅝" | Longitudinal and radial crack | Moderate | 12 | 9-12 |
| G | 13⅜" | Metal loss (different percentages) | Significant | 6 | 20-24 |
| H | 13⅜" | Longitudinal and radial crack | Intensive | 3 | 15-21 |

TABLE 7-continued

| Section 2 | | | | Defect Location | |
|---|---|---|---|---|---|
| Defect | Casing Size | Defect Type | Defect Intensity | Clock Position | Interval |
| I | 13⅜" | Internal and External Scattered Holes combined with tube ovalization | Moderate | 10 | 7-11 |
| J | 18⅝" | Longitudinal and radial crack | Moderate | 4 | 20-21 |
| K | 18⅝" | Internal and External Scattered Holes combined with tube ovalization | Intensive | 8 | 12-17 |
| L | 18⅝" | Metal loss (different percentages) | Significant | 7 | 1-5 |
| M | 24" | Internal and External Scattered Holes combined with tube ovalization | Significant | 1 | 23-26 |
| N | 24" | Metal loss (different percentages) | Moderate | 2 | 16-18 |
| O | 24" | Longitudinal and radial crack | Moderate | 7 | 3-5 |

Table-7: Description of man-made defects in gas well set-up in Section 2 of FIG. 5B.

Note: The precise location of man-made defects for Oil and Gas set-ups can be adjusted during the construction phase and should be kept under strict confidentiality FIG. 6 is a schematic diagram illustrating operation of the dummy well set-up of FIGS. 1A-C to perform leak detection testing in accordance with some implementations of the present disclosure. FIG. 7 is a process flow diagram for performing leak detection testing using the dummy well set-up of FIGS. 1A-C in accordance with some implementations of the present disclosure. In FIG. 6, defects in the tubulars are indicated, by defect 602, 604, 606, and 608.

As a preliminary matter, step 702 includes providing a dummy well in a wellbore, the dummy well including tubulars that include man-made defects at known locations. Step 704 includes determining conditions for simulating production, including fluid content, temperature, and pressure. At step 706, the leak detection or corrosion detection tool can be introduced into the dummy well.

At step 708, the production fluid simulant can be pumped into the dummy well.

At step 710, the fluid leaks through one or more of the defects.

Process the metal loss obtained by the corrosion logging tool

If the processed metal loss matches with the pre-set man-made metal loss, the corrosion logging tool is passed for commercial utilization in the oil field.

If the processed metal loss does not match with the pre-set man-made metal loss, the corrosion logging tool is not passed for commercial utilization in the oil field, and returned for appropriate actions as deem fit.

Inflow of oil, water, N2 gas into the dummy well.

Scenario-1: flow of fluid from crack/hole in the tubing to the annuli of tubing and 7" casing.

Fluid fill the annuli and build up pressure at the surface

Leak detection tool run into the well

Bleed of pressure in the annuli at surface while the leak detection tool making logging pass to identify and locate the leak point.

Run the tool inside the dummy well and log the well

Process the metal loss obtained by the corrosion logging tool

If the processed metal loss matches with the pre-set man-made metal loss, the corrosion logging tool is passed for commercial utilization in the gas field.

If the processed metal loss does not match with the pre-set man-made metal loss, the corrosion logging tool is not passed for commercial utilization in the gas field, and returned for appropriate actions as deem fit.

FIG. 8 is a block diagram illustrating an example computer system used to provide computational functionalities associated with described algorithms, methods, functions, processes, flows, and procedures as described in the present disclosure, according to some implementations of the present disclosure. The illustrated computer 802 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 802 can include input devices such as keypads, keyboards, and touch screens that can accept user information. Also, the computer 802 can include output devices that can convey information associated with the operation of the computer 802. The information can include digital data, visual data, audio information, or a combination of information. The information can be presented in a graphical user interface (UI) (or GUI).

The computer 802 can serve in a role as a client, a network component, a server, a database, a persistency, or components of a computer system for performing the subject matter described in the present disclosure. The illustrated computer 802 is communicably coupled with a network 830. In some implementations, one or more components of the computer 802 can be configured to operate within different environments, including cloud-computing-based environments, local environments, global environments, and combinations of environments.

At a top level, the computer 802 is an electronic computing device operable to receive, transmit, process, store, and manage data and information associated with the described subject matter. According to some implementations, the computer 802 can also include, or be communicably coupled with, an application server, an email server, a web server, a caching server, a streaming data server, or a combination of servers.

The computer 802 can receive requests over network 830 from a client application (for example, executing on another computer 802). The computer 802 can respond to the received requests by processing the received requests using software applications. Requests can also be sent to the computer 802 from internal users (for example, from a command console), external (or third) parties, automated applications, entities, individuals, systems, and computers.

Each of the components of the computer 802 can communicate using a system bus 803. In some implementations, any or all of the components of the computer 802, including hardware or software components, can interface with each other or the interface 804 (or a combination of both) over the system bus 803. Interfaces can use an application programming interface (API) 812, a service layer 813, or a combination of the API 812 and service layer 813. The API 812 can include specifications for routines, data structures, and object classes. The API 812 can be either computer-language independent or dependent. The API 812 can refer to a complete interface, a single function, or a set of APIs.

The service layer 813 can provide software services to the computer 802 and other components (whether illustrated or not) that are communicably coupled to the computer 802. The functionality of the computer 802 can be accessible for all service consumers using this service layer. Software services, such as those provided by the service layer 813, can provide reusable, defined functionalities through a defined interface. For example, the interface can be software written in JAVA, C++, or a language providing data in extensible markup language (XML) format. While illustrated as an integrated component of the computer 802, in alternative implementations, the API 812 or the service layer 813 can be stand-alone components in relation to other components of the computer 802 and other components communicably coupled to the computer 802. Moreover, any or all parts of the API 812 or the service layer 813 can be implemented as child or sub-modules of another software module, enterprise application, or hardware module without departing from the scope of the present disclosure.

The computer 802 includes an interface 804. Although illustrated as a single interface 804 in FIG. 8, two or more interfaces 804 can be used according to particular needs, desires, or particular implementations of the computer 802 and the described functionality. The interface 804 can be used by the computer 802 for communicating with other systems that are connected to the network 830 (whether illustrated or not) in a distributed environment. Generally, the interface 804 can include, or be implemented using, logic encoded in software or hardware (or a combination of software and hardware) operable to communicate with the network 830. More specifically, the interface 804 can include software supporting one or more communication protocols associated with communications. As such, the network 830 or the interface's hardware can be operable to communicate physical signals within and outside of the illustrated computer 802.

The computer 802 includes a processor 805. Although illustrated as a single processor 805 in FIG. 8, two or more processors 805 can be used according to particular needs, desires, or particular implementations of the computer 802 and the described functionality. Generally, the processor 805 can execute instructions and can manipulate data to perform the operations of the computer 802, including operations using algorithms, methods, functions, processes, flows, and procedures as described in the present disclosure.

The computer 802 also includes a database 806 that can hold data for the computer 802 and other components connected to the network 830 (whether illustrated or not). For example, database 806 can be an in-memory, conventional, or a database storing data consistent with the present disclosure. In some implementations, database 806 can be a combination of two or more different database types (for example, hybrid in-memory and conventional databases) according to particular needs, desires, or particular implementations of the computer 802 and the described functionality. Although illustrated as a single database 806 in FIG. 8, two or more databases (of the same, different, or combination of types) can be used according to particular needs, desires, or particular implementations of the computer 802 and the described functionality. While database 806 is illustrated as an internal component of the computer 802, in alternative implementations, database 806 can be external to the computer 802.

The computer 802 also includes a memory 807 that can hold data for the computer 802 or a combination of components connected to the network 830 (whether illustrated or not). Memory 807 can store any data consistent with the present disclosure. In some implementations, memory 807 can be a combination of two or more different types of memory (for example, a combination of semiconductor and magnetic storage) according to particular needs, desires, or particular implementations of the computer 802 and the described functionality. Although illustrated as a single memory 807 in FIG. 8, two or more memories 807 (of the same, different, or combination of types) can be used according to particular needs, desires, or particular implementations of the computer 802 and the described functionality. While memory 807 is illustrated as an internal component of the computer 802, in alternative implementations, memory 807 can be external to the computer 802.

The application 808 can be an algorithmic software engine providing functionality according to particular needs, desires, or particular implementations of the computer 802 and the described functionality. For example, application 808 can serve as one or more components, modules, or applications. Further, although illustrated as a single application 808, the application 808 can be implemented as multiple applications 808 on the computer 802. In addition, although illustrated as internal to the computer 802, in alternative implementations, the application 808 can be external to the computer 802.

The computer 802 can also include a power supply 814. The power supply 814 can include a rechargeable or non-rechargeable battery that can be configured to be either user- or non-user-replaceable. In some implementations, the power supply 814 can include power-conversion and management circuits, including recharging, standby, and power management functionalities. In some implementations, the power-supply 814 can include a power plug to allow the computer 802 to be plugged into a wall socket or a power source to, for example, power the computer 802 or recharge a rechargeable battery.

There can be any number of computers 802 associated with, or external to, a computer system containing computer 802, with each computer 802 communicating over network 830. Further, the terms "client," "user," and other appropriate terminology can be used interchangeably, as appropriate, without departing from the scope of the present disclosure. Moreover, the present disclosure contemplates that many users can use one computer 802 and one user can use multiple computers 802.

Described implementations of the subject matter can include one or more features, alone or in combination.

For example, in a first implementation, a computer-implemented method includes the following.

Example 1 is a method comprising running a downhole logging tool into a dummy well, the dummy well comprising a tubular; determining production conditions to simulate a well, the production conditions including a content, pressure, and temperature of a production fluid simulant; pumping the production fluid simulant into the dummy well through a flow-in tube; measuring at least one production characteristic using the downhole logging tool; and evaluating the downhole logging tool based on the production conditions.

Example 2 may include the subject matter of example 1, wherein the production conditions comprise a flow-rate for the production fluid simulant to flow through the well.

Example 3 may include the subject matter of any of examples 1-2, wherein the content of the production fluid simulant comprises one or a combination of water, oil, steam, and nitrogen.

Example 4 may include the subject matter of any of examples 1-3, wherein the production conditions comprise a downhole temperature in a range from 200 to 250 Fahrenheit.

Example 5 may include the subject matter of any of examples 1-4, wherein the production conditions comprise a downhole pressure in a range from 2000 to 2500 pounds per square inch.

Example 6 may include the subject matter of any of examples 1-5, wherein evaluating the downhole logging tool comprises comparing measured production values against predicted production values.

Example 7 may include the subject matter of any of examples 1-6, wherein the tubular comprises a man-made defect.

Example 8 may include the subject matter of example 7, wherein the downhole tool comprises a corrosion detection tool, the method including determining, using the corrosion detection tool, one or more of a location, type, or severity of the man-made defect; and determining the accuracy of the corrosion tool by comparing the determined location, type or severity of the man-made defect against known information.

Example 9 may include the subject matter of example 7, further comprising measuring pressure at a landing base and determining the affect of the man-made defect on production based on the measured pressure.

Example 10 a system comprising a dummy well comprising a plurality of concentric tubulars; a landing base to support the plurality of concentric tubulars; a flow-in tube comprising an inlet to receive production fluid simulant and a plurality of perforations to output production fluid simulant downhole of the dummy well; and a flow regulating device to control production conditions of production fluid simulant downhole of the dummy well.

Example 11 may include the subject matter of example 10, wherein the flow regulating device is configured to control a pressure and temperature of the production fluid simulant downhole.

Example 12 may include the subject matter of any of examples 10-11, further comprising a downhole logging tool configured to measure one or more downhole conditions.

Example 13 may include the subject matter of any of examples 10-12, wherein at least one of the concentric tubulars comprises a man-made defect of a known type at a known location and with a known severity.

Example 14 may include the subject matter of example 13, further comprising a corrosion detection tool configured to determine a location, type, and severity of the man-made defect.

Example 15 may include the subject matter of example 13, further comprising a leak detection tool to determine a leak caused by the man-made defect.

Example 16 may include the subject matter of any of examples 10-15, wherein the production fluid simulant comprises one or a combination of water, oil, steam, and nitrogen.

Example 17 may include the subject matter of any of examples 10-16, wherein the production conditions comprise a downhole temperature in a range from 200 to 250 Fahrenheit.

Example 18 may include the subject matter of any of examples 10-17, wherein the production conditions comprise a downhole pressure in a range from 2000 to 2500 pounds per square inch.

Example 19 may include the subject matter of any of examples 10-18, wherein the landing base comprises a man-made defect.

Example 20 may include the subject matter of example 19, further comprising a pressure sensor to determine an affect of the man-made defect at the landing base.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A method comprising:

running a downhole logging tool into a dummy well, the dummy well comprising a tubular;

determining production conditions to simulate a well, the production conditions including a content, pressure, and temperature of a production fluid simulant;

pumping the production fluid simulant into the dummy well through a flow-in tube;

measuring at least one production characteristic using the downhole logging tool; and evaluating the downhole logging tool based on the production conditions.

2. The method of claim 1, wherein the production conditions comprise a flow-rate for the production fluid simulant to flow through the well.

3. The method of claim 1, wherein the content of the production fluid simulant comprises one or a combination of water, oil, steam, and nitrogen.

4. The method of claim 1, wherein the production conditions comprise a downhole temperature in a range from 200 to 250 Fahrenheit.

5. The method of claim 1, wherein the production conditions comprise a downhole pressure in a range from 2000 to 2500 pounds per square inch.

6. The method of claim 1, wherein evaluating the downhole logging tool comprises comparing measured production values against predicted production values.

7. The method of claim 1, wherein the tubular comprises a man-made defect.

8. The method of claim 7, wherein the downhole logging tool comprises a corrosion detection tool, the method comprising:

determining, using the corrosion detection tool, one or more of a location, type, or severity of the man-made defect; and determining an accuracy of the corrosion detection tool by comparing the determined location, type or severity of the man-made defect against known information.

9. The method of claim 7, further comprising measuring pressure at a landing base and determining an effect of the man-made defect on production based on the measured pressure.

10. A system comprising:

a dummy well comprising a plurality of concentric tubulars;

a landing base to support the plurality of concentric tubulars;

a flow-in tube comprising an inlet to receive production fluid simulant and a plurality of perforations to output production fluid simulant downhole of the dummy well, wherein at least a portion of the flow-in tube is disposed within the dummy well; and a flow regulator to control production conditions of production fluid simulant downhole of the dummy well.

11. The system of claim 10, wherein the flow regulator is configured to control a pressure and temperature of the production fluid simulant downhole.

12. The system of claim 10, further comprising a downhole logging tool configured to measure one or more downhole conditions.

13. The system of claim 10, wherein at least one of the concentric tubulars comprises a man-made defect of a known type at a known location and with a known severity.

14. The system of claim 13, further comprising a corrosion detection tool configured to determine a location, type, and severity of the man-made defect.

15. The system of claim 13, further comprising a leak detection tool to determine a leak caused by the man-made defect.

16. The system of claim 10, wherein the production fluid simulant comprises one or a combination of water, oil, steam, and nitrogen.

17. The system of claim 10, wherein the production conditions comprise a downhole temperature in a range from 200 to 250 Fahrenheit.

18. The system of claim 10, wherein the production conditions comprise a downhole pressure in a range from 2000 to 2500 pounds per square inch.

19. The system of claim 10, wherein the landing base comprises a man-made defect.

20. The system of claim 19, further comprising a pressure sensor to determine an effect of the man-made defect at the landing base.

* * * * *